US011213713B2

(12) United States Patent
Bettini

(10) Patent No.: US 11,213,713 B2
(45) Date of Patent: Jan. 4, 2022

(54) EXERCISE TOOL

(71) Applicant: TECNOCOMPONENT S.R.L., Cesena (IT)

(72) Inventor: Luca Bettini, Cesena (IT)

(73) Assignee: TECNOCOMPONENT S.R.L., Cesena (IT)

( * ) Notice: Subject to any disclaimer, the term of this patent is extended or adjusted under 35 U.S.C. 154(b) by 0 days.

(21) Appl. No.: 16/699,311

(22) Filed: Nov. 29, 2019

(65) Prior Publication Data

US 2021/0162254 A1 Jun. 3, 2021

(51) Int. Cl.
*A63B 21/055* (2006.01)
*A63B 21/00* (2006.01)

(52) U.S. Cl.
CPC ..... *A63B 21/0555* (2013.01); *A63B 21/151* (2013.01)

(58) Field of Classification Search
CPC ..... A63B 21/00065; A63B 21/00185; A63B 21/02; A63B 21/028; A63B 21/04; A63B 21/0442; A63B 21/055; A63B 21/0555; A63B 21/0557; A63B 21/065; A63B 21/08; A63B 21/15; A63B 21/151; A63B 21/4023; A63B 21/4025; A63B 21/4043; A45D 8/36
See application file for complete search history.

(56) References Cited

U.S. PATENT DOCUMENTS 3,075,767 A 1/1963 Ono
4,733,862 A * 3/1988 Miller ..... A63B 21/0552 24/129 R
5,614,300 A 3/1997 Cicali et al.
5,624,359 A * 4/1997 Dean ..... A61H 1/02 482/131
7,794,374 B1 * 9/2010 Park ..... A63B 21/0552 482/122
10,124,204 B1 * 11/2018 Vo ..... A63B 21/0407
10,391,349 B2 * 8/2019 Wailes ..... A63B 21/4034
(Continued)

FOREIGN PATENT DOCUMENTS

GB 442378 2/1936

OTHER PUBLICATIONS

Supalak, Resistance Bands [online], Published: Jul. 8, 2019 <URL: https://www.amazon.com/dp/B08GCF4SN2> (Year: 2019).*
https://www.hygenic.com/about-us/ accessed Nov. 29, 2019.

*Primary Examiner* — Garrett K Atkinson
*Assistant Examiner* — Zachary T Moore
(74) *Attorney, Agent, or Firm* — Tutunjian & Bitetto, P.C.

(57) ABSTRACT

A tool for physical training and rehabilitation, including a plurality of rings linked in succession to make an open chain. At least some of said rings are elastic, and they include at least a core made of an elastic material and at least a covering of the core made of a material that is non-elastic with respect to the core, wherein the covering is substantially configured as an accordion such that when the core is not stressed under traction it has a large fitting on the core itself, and when the core is stressed under traction/extension the covering is extended in order to conform to the extension of the core. The core includes at least one elongated elastic element, having two opposite ends, and at least one connection member linked, or knotted, to the ends.

17 Claims, 9 Drawing Sheets

(56) References Cited

U.S. PATENT DOCUMENTS

| | | | | |
|---|---|---|---|---|
| 2006/0150997 | A1* | 7/2006 | Stephens | A45D 8/34<br>132/273 |
| 2007/0232468 | A1* | 10/2007 | Levy | A63B 21/028<br>482/121 |
| 2012/0108403 | A1* | 5/2012 | Zandman-Zeman | A63B 21/0555<br>482/121 |

* cited by examiner

EXERCISE TOOL

TECHNICAL FIELD OF THE INVENTION

The present invention concerns a tool for physical training and rehabilitation.

More particularly, the present invention refers to a tool of the type used in gyms, at home or in the field of rehabilitation for carrying out a variety of physical exercises.

BACKGROUND ART

It is known to use elastic bands as aid for physical training.

The principle underlying the relative use is to exploit the elasticity of the material with which the bands are made in order to execute a plurality of physical exercises which contemplate the repeated extension and contraction of the bands themselves.

In practice, it is possible to grip one end of an elastic band, or both, in order to perform exercises of stretching, extensions, tractions or even physiotherapy exercises, or simulate weightlifting.

The elastic bands can be constrained to the ground, to the wall or to other tools and they can also be used with feet or legs.

Hence, these are decidedly versatile devices since they allow performing a great variety of physical exercises with hands, arms, legs, back, etc., thus exercising many parts of the body.

Linear elastic bands, for example of length comprised between 50 cm and 7 m, and also ring-like elastic bands are available on the market.

In order to facilitate the gripping with hands and with feet, some manufacturers have mounted a handle at the ends of the elastic bands.

It is possible to carry out dozens of exercises that contemplate the use of elastic bands, each being aimed for exercising a corresponding part of the body.

One of the most well-known manufacturers is the US company The Hygenic Corporation, Akron, Ohio (USA), which for many years has sold elastic bands with the trademark "Thera Band™".

On the company website (www.hygenic.com), a guide can be consulted with regard to the physical exercises that can be performed with the elastic bands.

Independent of the commercial name used for the relative selling—elastic bands, elastic expanders, elastic ropes, fitness bands, resistance tubes, etc.—the currently existing solutions suffer some drawbacks or limits.

First of all, the resistance achieved by an elastic band depends unambiguously on the nature of the material used to make it, and on the size of the band itself, in terms of length, width and thickness.

In fact, once the band has been manufactured, it is not possible to adjust, as desired, the extension resistance achieved, and hence the return force.

This limit forces the user to provide himself/herself with a complete set of bands, each characterized by a precise resistance to extension.

For example, a typical set of elastic bands can comprise a band with minimum resistance, a band with medium resistance and a band with high resistance.

Gyms or rehabilitation centers are forced to purchase a multitude of elastic bands in order to meet the needs of the clients who, as can be easily imaged, can comprise adolescents, adults, women and men of different ages who have different physical characteristics and different needs regarding training or rehabilitation.

Despite having a multitude of elastic bands of different resistance available, the user is sometimes not satisfied by the response put forth by the elastic band which theoretically is most appropriate for him/her.

In these circumstances, users often use two elastic bands in parallel in order to obtain the desired resistance as a combination (or sum) of the resistances of the single elastic bands; however, this way of proceeding is uncomfortable and requires a lot of time.

Another drawback of the known solutions is the following.

The response put forth by an elastic band in terms of resistance to extension and return force depends on the material and on the size—as clarified above—and also on the extension that the band is forced to assume in a given moment.

In other words, the response put forth by a same elastic band also varies in relation to the extension to which the band is subjected in a certain time instant with respect to the contracted configuration, at rest.

In brief, therefore, the user must also often find the best extension of the elastic band before starting the exercise.

What has been described in relation to the elastic bands, with or without handles, generally applies to all those devices that can be considered equivalent, such as elastic tubular elements, elastic ropes, etc.

One proposed solution for increasing the versatility of the elastic tools of this kind is disclosed in document U.S. Pat. No. 5,614,300.

This document discloses a tool comprising a certain number of linked elastic rings (e.g. three in the shown embodiment).

More in detail, the tool comprises two kinds of elastic rings, i.e. at least one central ring of large size, and other lighter lateral rings of smaller size.

The central elastic ring comprises an elongated element, made of extensible material, whose ends are mutually connected with a buckle, in order to be opened to allow the user to modify the configuration of the tool itself.

The elastic rings of smaller size, laterally arranged, are instead obtained by stitching the ends.

As stated, the user can freely open the buckle of the central elastic ring and remove the lateral rings, so as to replace them with others having different features.

In the document, there is the possibility to make a chain with any number of elastic rings: in order to do this, it is necessary to alternate the different types of rings with each other.

The tool described in this document, as it is made, has considerable limitations of use: indeed, the elastic rings of smaller size are mainly conceived for being gripped by the user during the execution of the exercises, and hence they provide a very limited contribution in the overall extension of the tool.

Therefore, in order to obtain the desired extension, it is necessary to make a chain comprising a high number of rings of greater size which, as stated, can have greater extension: clearly, this is extremely uncomfortable, and requires the availability of various spare rings to be used only if necessary in relation to the kind of exercise to be carried out.

In addition, the elastic rings of smaller size, obtained via simple stitching, represent critical points in which the chain can be more easily broken during the execution of exercises where it is more stressed, or where there is greater extension.

Other solutions are known of tools comprising an open chain of elastic rings, for example those described in documents U.S. Pat. No. 3,075,767 and GB 442,378.

In U.S. Pat. No. 3,075,767, the linking of the elastic rings occurs by means of openable intermediate metal rings (so-called "key rings"), which considerably limit the types of exercises that can be carried out.

GB 442,378 instead is totally silent about the particular technique employed for obtaining the linking of the elastic rings.

SUMMARY OF THE INVENTION

The technical aim of the present invention is therefore to improve the state of the art in the field of tools for physical training and rehabilitation.

Within such technical aim, one object of the present invention is to provide a tool for physical training and rehabilitation that allows overcoming the limits and the drawbacks of the presently available solutions, and in particular allows adjusting as desired the resistance to the extension without necessarily varying the length of the tool itself.

Another object of the present invention is to make a tool for physical training and rehabilitation distinguished by performances greater than those of the tools of known kind with regard to the extension obtainable.

A further object of the present invention is to implement a tool for physical training and rehabilitation that allows ensuring optimal performances with regard to resistance to stresses.

Still another object of the present invention is to provide a tool for physical training that can be used in a more comfortable and effective manner than the equipment of known kind.

Another object of the present invention is to devise a tool for physical training of particularly versatile use, i.e. which allows effectively carrying out a high number of possible exercises.

Such aim and such objects are all achieved by the tool for physical training and rehabilitation according to the present application.

The tool comprises a plurality of rings linked in succession to make an open chain; each of the rings is grippable with hands, or engageable by other parts of the body of the user, in such a manner such that the user himself/herself can obtain the desired resistance to traction desired for the specific exercise to be performed in relation to the number of rings of the chain actually placed under traction/extension.

At least some of the rings of the chain are elastic, and each of them comprise at least one core made of an elastic material and at least one covering of the core made of a material that is non-elastic with respect to the core. The covering is substantially configured as an accordion, such that when the core is not stressed under traction it has a large fitting on the core itself, and when instead the core is stressed under traction/extension the covering is extended in order to conform to the extension of the core.

According to one aspect of the invention, the core of each of the elastic rings comprises at least one elongated elastic element, having two opposite ends, and at least one connection member linked, or knotted, to said ends.

The great advantage provided by the chain solution—and mostly the open chain solution—with respect to the known solutions, is the following.

The user can select how many elastic rings to use in a given moment for the physical exercise, i.e. he/she can use one section of the chain, as desired, by gripping, for example, the first and last ring of such section, if an exercise is carried out in which the tool is not constrained to any fixed support.

The rings that are more external with respect to the two gripped rings do not intervene during the exercise, in the sense that they are not stressed under traction/extension and therefore they do not put forth resistance.

In fact, the user is thus free to decide how many rings of the chain to use each time, and this has a direct consequence on the overall resistance to extension put forth by the tool.

It is a simple but effective way to adjust the overall resistance put forth by the tool.

Each ring has its own resistance to traction; the number of rings determines both the useful range of extension (greater with a greater number of rings) and the range of resistance that is encountered during the extension for that specific section (greater with a smaller number of rings).

The tool according to the present invention is therefore extremely versatile.

Another advantage of the present invention consists of the fact that the response put forth by the elastic chain when the user places it under traction, i.e. extends it, is definitely more linear compared to an elastic band of the prior art, given the same initial length of chain and the same band used for the exercise.

The reason is due to the fact that a conventional elastic band subjected to traction tends to contract in transverse direction, while the elastic chain according to the present invention does not undergo this phenomenon, since each ring is deformed independently from the others.

All the rings of the chain are grippable with hands, so that the user can each time grasp the rings corresponding to the resistance to traction desired for the exercise to be executed.

In addition, all the rings of the chain can be engaged by other parts of the body of the user in addition to hands, for example arms, legs or feet.

According to one aspect of the invention, the elastic element can be a rubber tube, an elastic rope, an elastic band, or a combination of these elements.

According to another aspect of the invention, the covering is a tube of fabric fit on the core.

The covering can for example be made of natural fabric, synthetic fabric (e.g. nylon), non-woven fabric, or still other materials.

The covering follows the extension of the core only to the extent in which it is completely extended starting from the accordion configuration, but not beyond, thus acting as a limiter.

For example, if the separately-considered core can extend four times the initial length, the covering is configured in order to not be stretched over four times the initial length of the core, so to prevent the core from approaching the relative structural limit.

The covering has at least the double object of limiting the extension of the core, and hence of the elastic ring, and of protecting the core itself from the mechanical standpoint, for example from cuts, abrasions and wear.

The covering also has the function of protecting the user in case of breakage of the core contained therein.

Indeed, in such case the covering can prevent the failure of the chain of elastic elements.

It must in fact be observed that the conventional elastic bands, if they are broken or released while taut, generate a whip effect that can be extremely dangerous; on the other hand, a sequence of elastic rings, when released (or broken), not constituting a single body, does not allow the transmission of the elastic energy, which is independently dissipated during the recovery of the rest length in each ring.

In addition, the covering facilitates and makes more comfortable the gripping with hands—or the engagement with other parts of the body—of each ring.

More particularly, since the elongated elastic element of the core can be constituted, for example, by at least one elastic tube, an elastic rope, an elastic band, or even by a combination of these elements, the user could have difficulty in gripping it, since its surface is rough and tends to adhere to the skin or to clothes.

In general, the rings of the chain can be identical to each other, or they can be different due to at least one size characteristic—e.g. the diameter of the core of the rings, or due to at least one structural characteristic—or even due to the nature of the material used for the core of the rings.

Preferably the number of rings is comprised between three and thirty, and more preferably between five and twenty.

According to one aspect of the invention of particular practical interest, the aforesaid connection member of the ends of the elongated elastic element is made of yielding and non-elastic material, and it extends over a pre-established portion of the length of the respective ring.

The aforesaid connection member can comprise a strip provided with two opposite terminal eyelets, with which the ends of the elongated elastic element are connected (or more specifically, linked or knotted).

All this is covered by an external protective sheath, which also covers the covering at the aforesaid connection member.

The latter solution is advantageous from multiple standpoints.

First of all, it is a particularly practical, quick and effective solution for obtaining the connection between the two ends of the elongated elastic element, which can also be actuated without the use of particular machinery.

In addition, it is a very strong and reliable solution, which considerably reduces the risks of accidental breakage of the core of each ring, even when the chain of rings is considerably lengthened.

Moreover, since the aforesaid connection section is not extensible, and it is made of a material different from that constituting the elongated elastic element, it can be effectively used—as will be better described hereinbelow—for effectively and safely constraining the tool to a fixed support.

For the same reasons briefly set forth above, the connection section also constitutes an optimal zone for grasping the ring with a hand.

In another embodiment of the invention, the tool comprises at least one fixed support, and at least one element for fixing at least one of the rings to such fixed support, in order to carry out various types of exercises, as better described hereinbelow.

In one embodiment of the invention, at least some of the rings of the chain comprise respective and distinct identification elements.

Such identification elements can be selected from among progressively increasing numbers, strips, dots, or other signs that indicate or refer to a progressively increasing numbering.

In one embodiment, the identification elements can be arranged symmetrical with respect to the central rings of the chain.

The present application refers to preferred and advantageous embodiments of the invention.

BRIEF DESCRIPTION OF THE DRAWINGS

These and further advantages will be better understood by the skilled person from the following detailed description and from the enclosed drawings, given as a non-limiting example, in which.

DETAILED DESCRIPTION

Figure 1:
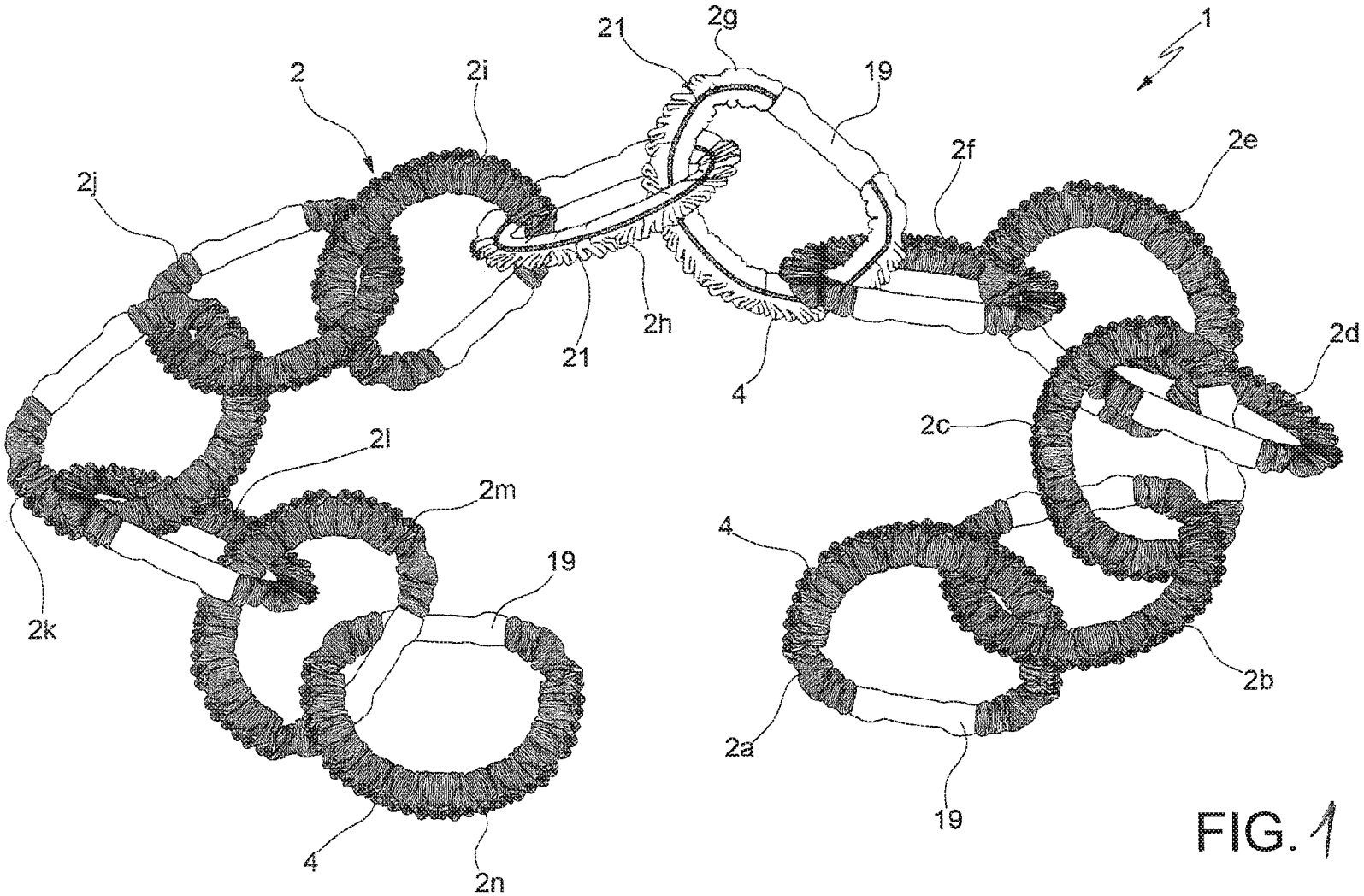
FIG. 1 is a perspective view of the tool according to the present invention.

With reference to FIG. 1, reference number 1 overall indicates a tool for physical training and rehabilitation according to the present invention.

Tool 1 comprises a plurality of rings 2*a*-2*n*, linked in succession to make an open chain 2; at least some of such rings 2*a*-2*n* can be elastic; tool 1 further comprises two opposite terminal elastic rings 2*a*,2*n*, which respectively define the two ends of the chain 2.

Each of the rings 2*a*-2*n* is grippable with hands, to perform specific exercises.

Or, each of the rings 2*a*-2*n* is engageable by other parts of the body of the user U (e.g. arms, legs, feet, etc.), for performing other kinds of exercises.

The fact that each of the rings 2*a*-2*n* is autonomously grippable (or engageable) by the user U allows the latter to achieve the desired resistance to traction for the specific exercise to be performed, in relation to the number of rings 2*a*-2*n* actually placed under traction/extension.

In the specific embodiment shown in FIG. 1, all rings 2*a*-2*n* of the chain 2 are elastic.

As will be better explained later, however, it is possible to conceive embodiments of the invention in which one or more of the rings 2*a*-2*n* of the chain are not elastic.

Each of the elastic rings 2*a*-2*n* comprises at least a respective core 3, made of an elastic material.

In addition, each of the elastic rings 2*a*-2*n* comprises at least a respective covering 4 of the core 3; the covering 4 is made of a material that is non-elastic with respect to the core 3 itself.

The covering 4 of each of the elastic rings 2*a*-2*n* is substantially configured as an accordion; this means that when the core 3 is not stressed under traction, the covering 4 has a large fitting on the core 3 itself, and assumes a substantially curled configuration, i.e. collected, compact; when instead the same core 3 is stressed under traction/extension during the execution of an exercise, and hence it is extended by a certain length, the covering 4 is extended by following the extension of the core 3 itself.

According to an aspect of the invention, the core 3 of each of the elastic rings 2*a*-2*n* comprises at least an elongated elastic element 5.

The elongated elastic element 5, when it is not assembled in one of the elastic rings 2*a*-2*n*, has an open linear configuration.

The elongated elastic element 5 comprises two opposite ends 5*a*,5*b*.

In addition, the core 3 of each of the elastic rings 2*a*-2*n* comprises at least one connection member 6 linked, or knotted, with the aforesaid ends 5*a*,5*b*.

The task of the connection member 6 is mainly closing the elongated elastic element 5 on itself as a loop.

The connection member 6 is enclosed within the covering 4.

In addition, in each of the elastic rings 2*a*-2*n*, the covering 4 is made integral with the respective core 3 at the aforesaid connection member 6; in other words, the sliding of the core 3 within the covering 4 is prevented, since both are mutually tied up just with the connection member 6.

In addition, as better described hereinbelow, the core 3 and the covering 4 are tied up with each other in a very firm and secure manner at such connection member 6: indeed, the accidental separation of the covering 4 from the core 3 is an event that must be absolutely avoided, since it can lead to the quick breakage of the covering 4 itself, or in any case to an incorrect and uncomfortable use of the tool 1.

According to another aspect of the invention, the connection member 6 is made of yielding and non-elastic material.

In addition, the connection member 6 extends along a pre-established portion of the length of the respective elastic ring 2*a*-2*n*.

In other words, the two ends 5*a*,5*b* of the elongated elastic element 5 are not directly in contact with each other, but a certain distance is provided between them that is filled by the connection member 6.

Such distance does not change even when the elastic ring 2*a*-2*n* is placed under traction.

The advantages connected with these technical solutions will be clearer hereinbelow.

Figure 6:
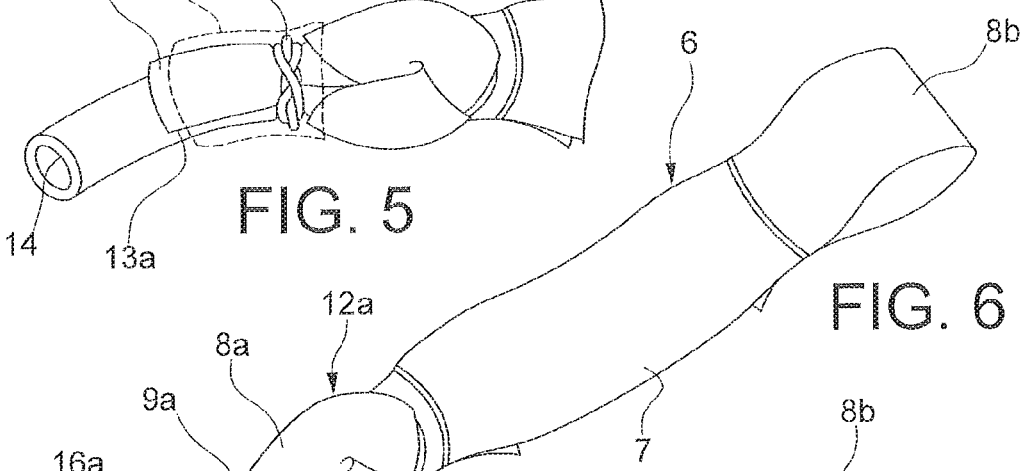
FIGS. 6,7,8 are detailed perspective views of subsequent coupling steps of the connection member to the elongated elastic element of one of the elastic rings.

The connection member 6 comprises at least a strip 7, provided with two opposite terminal eyelets 8*a*,8*b* (see for example FIG. 6).

The terminal eyelets 8*a*,8*b* are respectively connected with the aforesaid ends 5*a*,5*b* of the elongated elastic element 5.

The connection between the two terminal eyelets 8*a*,8*b* and the ends 5*a*,5*b* can be obtained via chaining, or via knot-tying, as better clarified hereinbelow.

The aforesaid strip 7 is made of a material selected from among a natural fabric, a synthetic fabric, a non-woven fabric, a composite material, or in any case any other material suitable for being easily bent and/or twisted, without however being extended.

Figure 8:
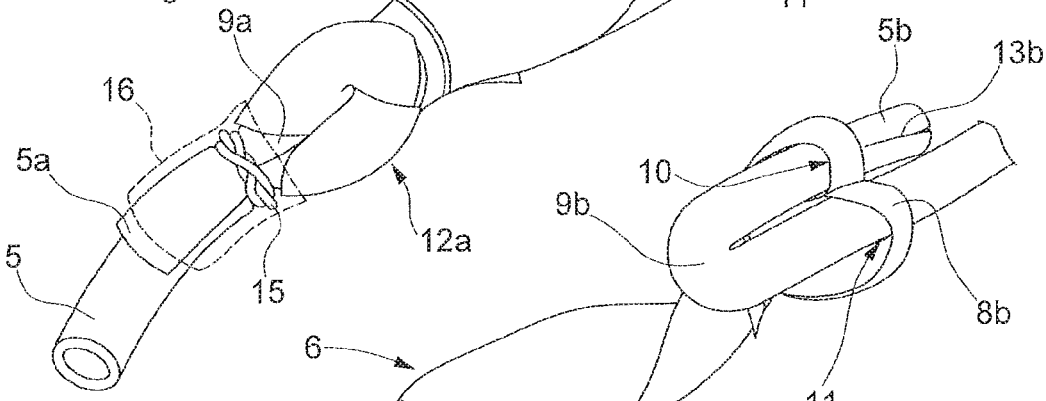
Figure 8:
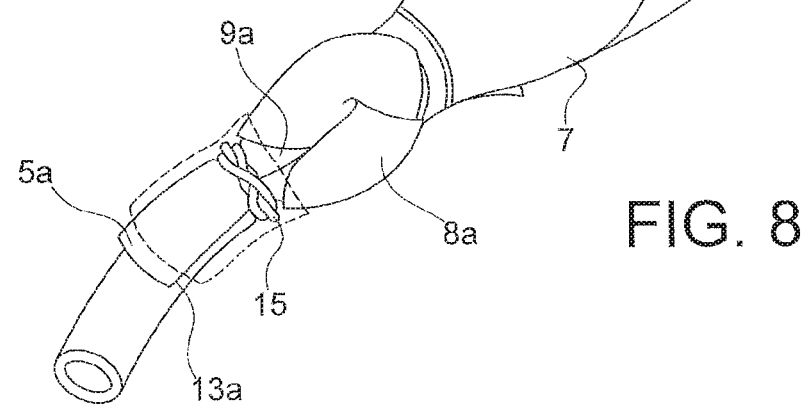

Each of the ends 5*a*,5*b* of the elongated elastic element 5 is inserted in a respective terminal eyelet 8*a*,8*b* of the strip 7, it is folded upon itself and constrained to the same elongated elastic element 5, so as to make a respective counter-eyelet 9*a*,9*b*, as shown in FIG. 8.

Figure 7:
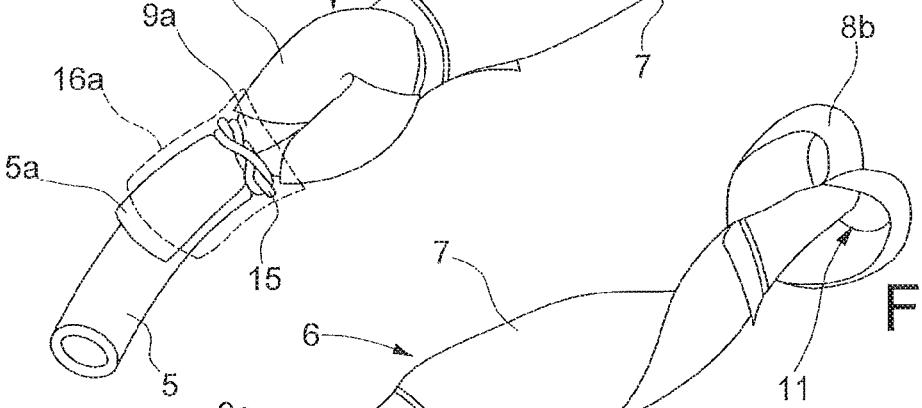

According to still another object of the invention, each of the terminal eyelets 8*a*,8*b* of the strip 7 has the respective terminal portion twisted or bent, in the sense that it is overturned on itself towards the interior of the cavity of the terminal eyelet 8*a*,8*b* itself (as shown in FIG. 7).

This overturning of each terminal portion in turn defines, for each of the terminal eyelets 8*a*,8*b*, two contiguous passages 10,11, for the insertion of the respective end 5*a*,5*b* of the elongated elastic element 5: such insertion occurs first in one direction, and then in the opposite direction (FIG. 8).

Figure 2:
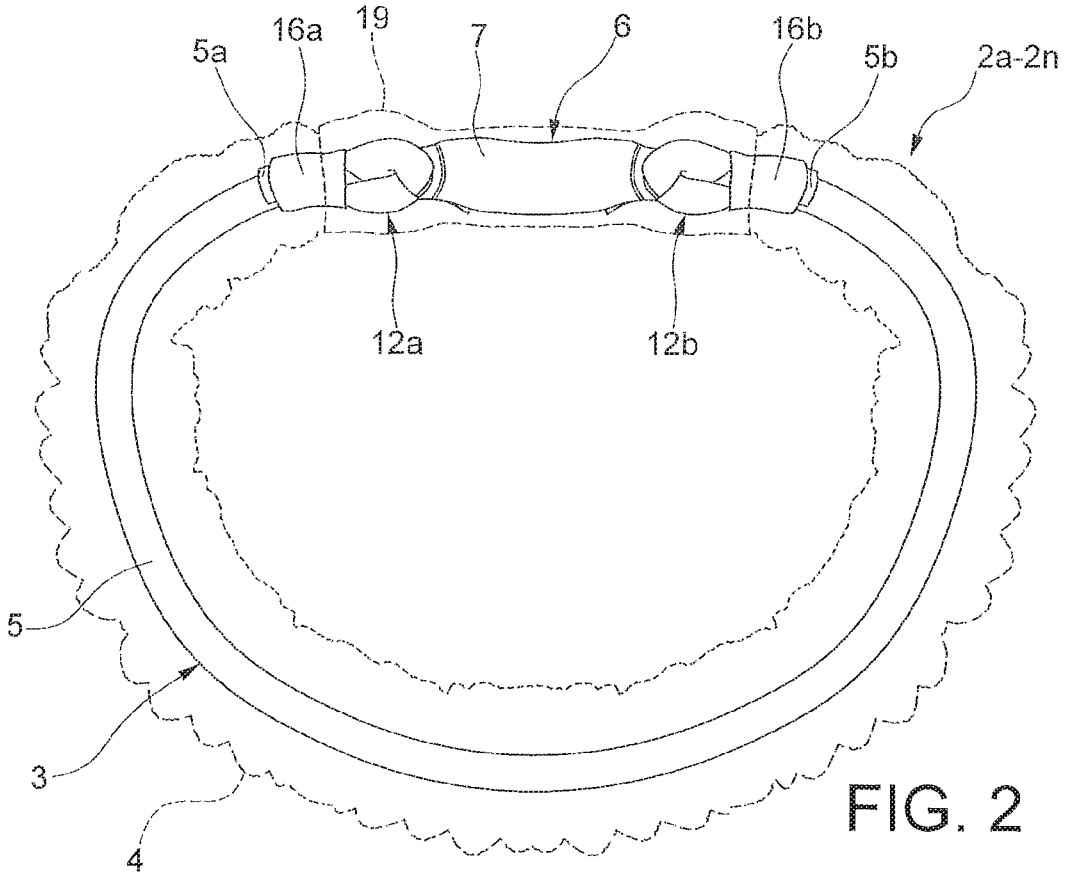
FIG. 2 is a detailed plan view of one of the elastic rings of the tool according to the invention, with the covering shown in a non-continuous section for greater clarity.
Figure 3:
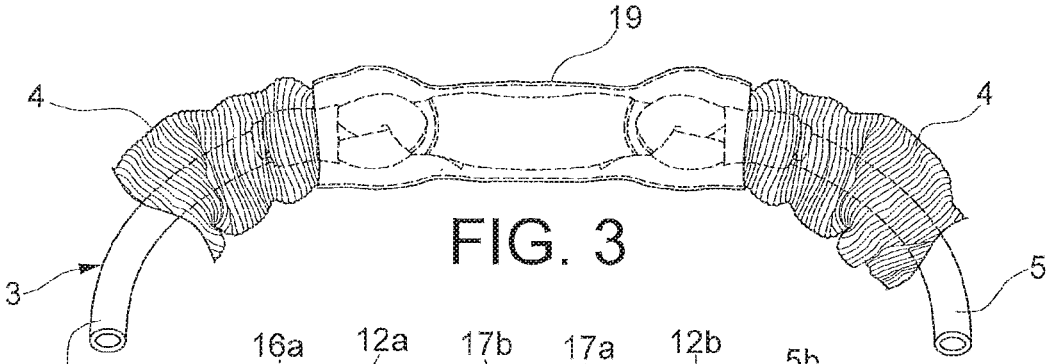
FIG. 3 is a detailed plan view of one of the elastic rings, at the zone of the connection member.

In such a manner, two compact linking zones 12*a*,12*b* are obtained—one for each of the ends 5*a*,5*b*—between the strip 7 and the elongated elastic element 5 (FIG. 2,4).

At each of such linking zones 12*a*,12*b*, the strip 7 encloses the respective counter-eyelet 9*a*,9*b* of the elongated elastic element 5.

In other words, each counter-eyelet 9*a*,9*b* is completely wrapped and covered by the respective terminal eyelet 8*a*,8*b* of the strip 7, due to the particular shape of the obtained linking zone 12*a*,12*b*.

In addition, the traction exerted during the execution of the exercises facilitates the further tightening and locking of the linking zones 12*a*,12*b*.

This constitutes an important safety guarantee against possible accidental breakage or releases.

In other embodiments of the invention, the connection member 6 could have a different configuration.

For example, the connection member 6 could comprise multiple strips 7, or one or more cables or ropes in place of the strips 7, also combined in various ways.

Essential requirements of the employed solution are pliability and strength, and also a certain sensation of comfort in the gripping.

The elongated elastic element 5 is selected from among an elastic tube, an elastic rope, an elastic band, or the like, or even a combination thereof.

In the embodiment illustrated in the figures, which is of particular practical interest, the elongated elastic element 5 is constituted by an elastic tube.

The elastic tube can ensure extensions, given the same exerted traction, greater than other potentially usable solutions, even if with a radial bulk and a weight that are extremely limited.

In addition, the choice of the elastic tube allows obtaining other technical advantages, better clarified hereinbelow.

Indeed—and according to another aspect of the present invention—each of the ends 5*a*,5*b* of the elongated elastic element 5—i.e. of the elastic tube—is covered by at least one respective longitudinal cut 13*a*,13*b*.

Each longitudinal cut 13*a*,13*b* is made in the wall 14 of the elastic tube 5.

Each longitudinal cut 13*a*,13*b* extends for a certain pre-established length; it allows opening the wall 14 of the elastic tube 5, such that said wall 14 can enclose the external surface of the tube 5 itself, after the bending necessary for making the respective counter-eyelet 9*a*,9*b*.

This expedient allows obtaining an embodiment solution that is particularly compact and effective, in which the transverse bulk of the elongated elastic element 5 at each of the counter-eyelets 9*a*,9*b* is reduced to the minimum: this is obtained due to the particular choice of making the elongated elastic element 5 in the form of an elastic tube.

Each of the ends 5*a*,5*b* of the elongated elastic element 5, folded upon itself in order to obtain the counter-eyelet 9*a*,9*b*, is constrained to the external surface of the elongated elastic element 5 itself by means of a respective tightening element 15 (FIGS. 5-8).

Each tightening element 15 can be constituted, for example, by a band or a rope, possibly elastic, tightened and knotted so as to fasten around both the elongated elastic element 5 and the respective end 5*a*,5*b* bent thereon.

Outside the tightening element 15, at each of the ends 5*a*,5*b*, a further respective protective tubular clamp 16*a*,16*b* is provided, inserted along the elongated elastic element 5. Each tubular clamp 16*a*,16*b* is sized in a manner such to be elastically expanded in radial direction in order to fit along the respective counter-eyelet 9*a*,9*b*, which is then suitably compacted and blocked; in addition, each tubular clamp 16*a*,16*b* also has the function of preventing the accidental release or disengagement of the respective tightening element 15.

According to one aspect of the invention, the connection member 6, made of yielding but not elastic material, constitutes an effective preferred grip zone during the execution of the exercises.

Indeed, when any elastic ring 2*a*-2*n* is gripped with the hand by the user U (or engaged by another part of the body) and placed under traction, the core 3 and the covering 4 (even if constrained to each other at at least one zone of the elastic ring 2*a*-2*n*, as better described hereinbelow), due to their different characteristics tend to slide with respect to each other; more in detail, by gripping an elastic ring 2*a*-2*n* at any one point that is not the zone of the connection member 6, the covering 4 remains essentially stopped with respect to the palm of the hand, while the core 3 is elongated, and hence tends to slide, or in any case be moved, at its interior.

The user U can then feel a sensation of instability in gripping, or even worse, that the gripped elastic ring 2*a*-2*n* can escape from his hand during the execution of an exercise.

As stated, rather, the connection member 6 is not elastically extensible, and hence it is not elongated during the traction of the elastic ring 2*a*-2*n*; this means that, by grasping the elastic ring 2*a*-2*n* precisely at the connection member 6, the user U does not feel any movement or sliding within the covering 4, since the two parts are mutually stopped with respect to each other.

This considerably increases the sensation of comfort and stability during the execution of the exercises with the tool 1 according to the present invention.

The covering 4 of each of the elastic rings 2*a*-2*n* comprises at least one tube, made of yielding and not elastically extensible material, and configured as an accordion as mentioned above.

The yielding and not elastically extensible material of the covering 4 can for example by a natural or synthetic fabric, a non-woven fabric, a composite material or other materials suitable for such purpose.

In one embodiment of the invention of particular practical interest, the covering 4 is made of nylon fabric, or another material with similar properties.

The covering 4 can also act as a limiter for the extension of the elongated elastic element 5, since during traction it—being made of material that is not elastically extensible—can be elongated only up until it is completely extended: in other words, if desired, the covering 4 follows the extension of the elongated elastic element 5 only for a certain length.

Different extension behaviors can be clearly obtained by varying the features of the covering 4, and more in detail by suitably selecting its length when it is in a completely extended configuration.

Figure 4:
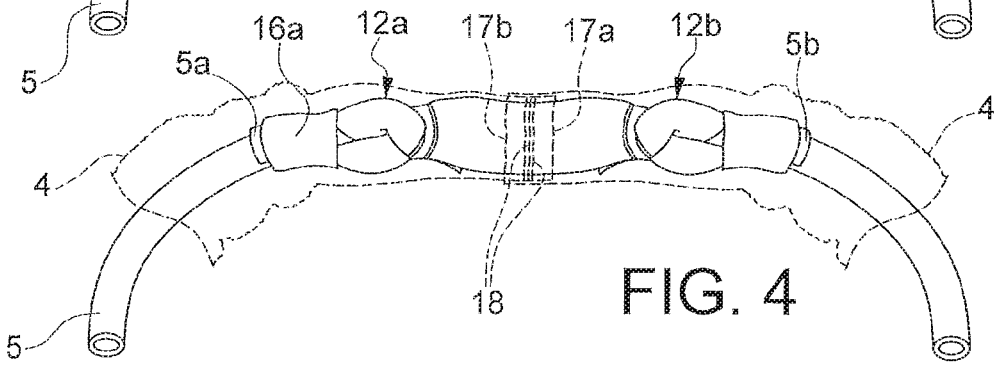
FIG. 4 is a detailed plan view of one of the elastic rings at the zone of the connection member, with the covering shown in a non-continuous section for greater clarity.
Figure 5:
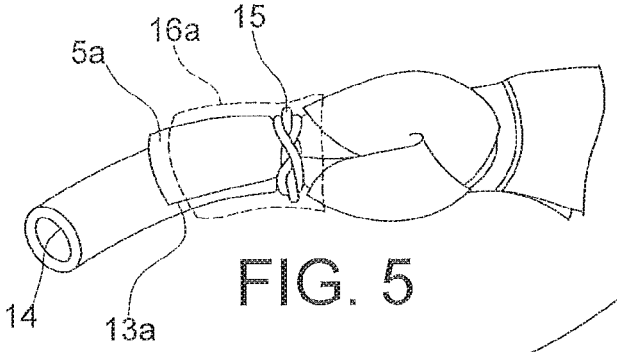
FIG. 5 is a detailed perspective view of a portion of the connection member of one of the elastic rings.

The covering 4 comprises two terminal ends 17*a*,17*b*, inserted inside each other as shown in FIG. 4; in other words, the two terminal ends 17*a*,17*b* are superimposed on each other for a section of suitable length.

More in detail, the two terminal ends 17*a*,17*b* are superimposed on each other at the connection member 6.

In addition, the two terminal ends 17*a*,17*b* are fixed to each other by means of constraining means 18, selected for example from among stitching, gluing, stapling, or the like.

According to another aspect of the invention, each elastic ring 2*a*-2*n* comprises at least one respective elastic protective sheath 19 of the covering 4.

The protective sheath 19 is applied at the connection member 6.

In one embodiment of the invention of particular practical interest, the protective sheath 19 is constituted by a tubular elastic band.

The protective sheath 19 can be made of elastomer—e.g. of natural or synthetic rubber—or of another material with similar properties.

The protective sheath 19 is sized in a manner such to be elastically expanded in radial direction in order to fit along the covering 4; in assembled configuration, therefore, the protective sheath 19 encloses the covering 4 at the connection member 6 in a very tight manner, such that the core 3 and the covering 4 itself are firmly locked with respect to each other.

The protective sheath 19, in addition to having the important function of protecting the connection member 6 of the elongated elastic element 5, as well as that of maintaining the core 3 and the covering 4 firmly constrained with respect to each other, allows obtaining other important technical effects.

As clarified above, the zone of the connection member 6 can be a preferred point where to grip/engage an elastic ring 2*a*-2*n*, for the above-described reasons; the presence of the protective sheath 19 made of elastomeric material further emphasizes the advantages of this expedient.

In fact, the friction coefficient existing between the external surface of the protective sheath 19 and the palm of the hand, or between the external surface of the protective sheath 19 and another part of the body of the user U with which the exercise is executed, is considerably greater than that existing between the covering 4 and the same parts of the body of the user U: consequently, the grip or engagement are much safer and firmer.

For these same reasons, moreover, also due to the presence of the protective elastomer sheath 19, the zones of the elastic rings 2*a*-2*n* that are situated at the connection members 6 can allow obtaining a more stable behavior of the tool 1 during the execution of the exercises.

Indeed, when some (or even all) the elastic rings 2*a*-2*n* are placed under traction during the execution of a specific exercise, they are initially free to move with respect to each other, until an equilibrium condition is reached inside the chain 2 in which, indeed under tension, they are mutually stopped.

The zone of the connection member 6, therefore, both due to the fact that the latter is not elastically extensible, and due to the fact that it is covered by a protective sheath 19 which externally has a high grip, is a zone at which the elastic rings 2*a*-2*n* could preferably be stopped with respect to each other due to adhesion.

Therefore, even when the chain 2 of elastic rings 2*a*-2*n* is momentarily slackened, for example in order to vary the position of an exercise, or to relax the muscles between one exercise and the next, the adhesion at each protective sheath 19 obstructs the movements of the elastic rings 2*a*-2*n* themselves with respect to each other.

In addition, the fact that a specific elastic ring 2*a*-2*n* is linked to the immediately following ring at the zone of the connection member 6—which is not elastically extensible—creates a particular condition of symmetry in the extension/elongation of the ring 2*a*-2*n* itself.

Indeed, in this manner the two parallel branches of the elastic ring 2*a*-2*n* (i.e. the two sections of each ring 2*a*-2*n* comprised between the points of linking with the adjacent rings 2*a*-2*n*) have the same elastic behavior, and hence are elongated by essentially the same amount.

This particular symmetry condition however cannot be obtained if the connection/linking of the same ring 2*a*-2*n* with the immediately following ring occurs at any point of the ring 2*a*-2*n* itself, i.e. not coinciding with the zone of the connection member 6, and not even the one diametrically opposite to the latter.

Indeed, in such case the two branches of the ring 2*a*-2*n* through which the tension is transmitted have very different elastic behaviors with respect to each other, and this clearly causes an imbalance condition, or in any case a limitation in the possibilities of elongation of the ring 2*a*-2*n* itself.

Therefore, for the above-described grounds, the best elongation behavior of the chain 2 is obtained by ensuring that when the chain 2 itself is placed under traction, the mutual linking of the elastic rings 2*a*-2*n* occurs precisely at the aforesaid zones corresponding to the connection members 6 (and of course at those zones diametrically opposite thereto).

In one embodiment of the invention (in particular the one illustrated in FIG. 1), the chain 2 of the tool 1 comprises at least one central elastic ring 2*g*,2*h*, whose covering 4 can be visually distinguished from the covering 4 of the remaining elastic rings 2*a*-2*f* and 2*i*-2*n*.

In case of execution of symmetrical exercises—i.e. which involve, for example, two limbs or extremities simultaneously—this allows immediately identifying the center of the chain 2: for example, the aforesaid central elastic ring 2*g*,2*h* can thus be quickly constrained to a fixed support 20 (as better described hereinbelow), or engaged and/or retained by another part of the body, in order to be held stationary (as shown, for example, in FIGS. 9,10, in which the user U retains the central zone of the chain 2 with the feet).

In another possible use, the at least one central elastic ring 2*g*,2*h*, whose covering 4 can be visually distinguished, allows carrying out kinds of exercises in which one will be using a high resistance to traction: in this case the user, due to the visually distinguishable central rings 2*g*,2*h*, can immediately and easily bend the chain 2 in two, thus doubling the resistance to traction.

This can be of particular aid if the chain 2 comprises a high number of elastic rings 2*a*-2*n*.

In the embodiment illustrated in FIG. 1, the tool 1 comprises two central elastic rings 2*g*,2*h*, whose coverings 4 are visibly distinguishable from others: this allows better exploiting the median zone of the chain 2 for possible, and immediate, fixing/engaging to fixed supports 20, or to other parts of the body, for the execution of symmetrical exercises.

In the embodiment represented in FIG. 1, the covering 4 of the central elastic rings 2*g*-2*h* is made visually distinguishable since it comprises, for example, graphic elements 21 of different color with respect to that of the covering 4.

Alternatively, any other technique can be used that is suitable to create a different aspect of the central elastic rings 2*g*,2*h* with respect to the remaining elastic rings 2*a*-2*f* and 2*i*-2*n*.

In other embodiments of the invention, the entire covering 4 of the central elastic rings 2*g*,2*h* can be made of different color with respect to that of the remaining rings 2*a*-2*f* and 2*i*-2*n*, or of a different combination of colors, or similar expedients.

Other possible solutions for making the coverings 4 of the two central elastic rings 2*g*,2*h* visually distinguishable from the others can be actuated; for example, simple labels can be provided that are externally fixed to the covering 4.

In still another embodiment of the invention, the central elastic rings 2*g*,2*h* could be made visually distinguishable since they are made with different sizes (for example, larger) with respect to the remaining elastic rings 2*a*-2*f* and 2*i*-2*n*.

Figure 12:
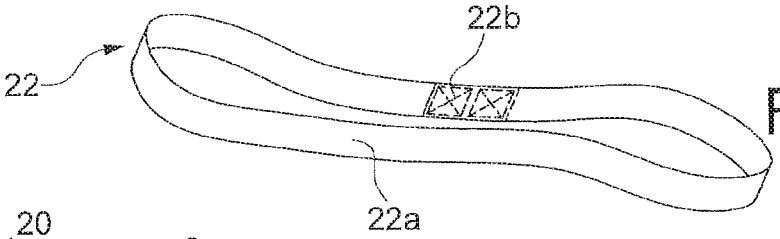
FIG. 12 is a schematic perspective view of the fixing element of FIG. 11.
Figure 11:
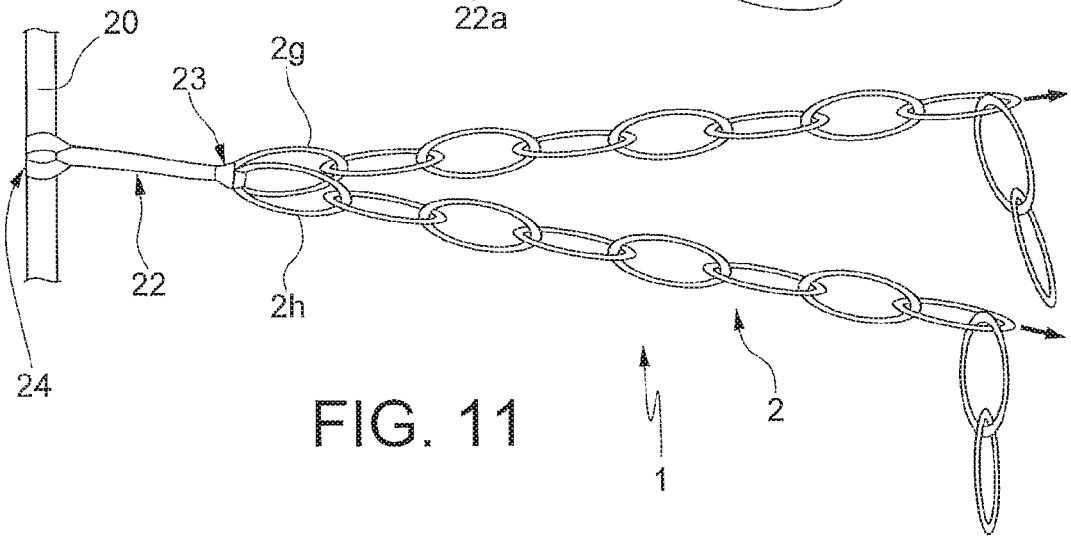
FIG. 11 is a schematic perspective view of another embodiment of the tool according to the invention, also comprising a fixed support and an element for fixing the chain of rings to such fixed support.

Another embodiment of the invention is shown in FIGS. 11,12.

This embodiment differs from the previous one in that tool 1 comprises at least one fixed support 20.

In addition, tool 1 comprises at least one element 22 for fixing at least one of the elastic rings 2*a*-2*n* to the aforesaid fixed support 20.

The fixed support 20 can be of any type and of any nature; the fixed support 20 can be constituted by any object/element capable of safely supporting the stress transmitted by the elastic rings 2*a*-2*n* placed in traction by the user U, without any limitation.

For example, the fixed support 20 could be constituted by any element—a bar, a hook, or the like—fixed to the ground, to the wall or to the ceiling inside a gym or other similar settings.

In one embodiment of the invention, the fixed support 20 can include a bar, arranged with a horizontal or vertical axis.

The fixed support 20 could also be constituted by a pole, a shaft, or the like, in case, instead, of execution of outdoor exercises.

The fixing element 22 comprises—by way of a non-limiting example—at least a band, or sling, 22*a*.

Preferably, the band 22*a* is made of yielding and non-elastic material: for example, the band 22*a* can be made of natural or synthetic fabric, non-woven fabric, a composite material or other suitable materials.

The band 22*a* is schematically shown in FIG. 12.

The band 22*a* can be closed on itself as a loop, with the ends mutually connected, for example, with stitches 22*b* or the like; or, the band 22*a* could also be open, with the ends provided with connecting means of any suitable type (e.g. snap-hooks, or the like).

In other embodiments of the invention, the fixing element 22 could be constituted by a rope, a lace, a chain, a hook, or any combination of such elements.

According to an aspect of the invention, the connection member 6 of each of the elastic rings 2*a*-2*n* of the chain 2 constitutes the preferred mating area with the fixing element 22.

This allows to obtain the best elastic expansion without risking damage the elongated elastic element 5.

FIG. 11 schematically shows a possible connection way of the chain 2 to a fixed support 20, by means of a fixing element 22 comprising a band 22*a*.

More in detail, in this case the fixed support 20 is constituted by a bar, or a rod, or the like.

The bar can be arranged vertically or even horizontally.

The band 22*a* is made to pass through one of the elastic rings 2*a*-2*n* of the chain 2 (for example one of the central elastic rings 2*g*,2*h*), so as to partially wrap it; subsequently a portion of the band 22*a* is made to pass again through the same opening thereof, so as to obtain the first bond 23, or linking, shown in FIG. 11.

In an embodiment of the invention, the first bond 23, therefore, is carried out at the connection member 6 of one of the elastic rings 2*a*-2*n* of the chain 2 (for example, one of the central elastic rings 2*g*,2*h*).

In another embodiment of the invention, the first bond 23 is carried out at the contact area between the connection members 6 of two adjacent elastic rings 2*a*-2*n* (preferably, but not exclusively, the two central elastic rings 2*g*,2*h*).

In this way, the fixing element 22 is coupled, to the chain 2, at a particularly solid and rigid area, constituted, precisely, by the contact area between the connecting members 6 of two adjacent elastic rings 2*a*-2*n*.

Afterwards, the same portion of the band 22*a* is made to pass around the fixed support 20; once this is completed, the entire chain 2 is then inserted through the opening of the same portion of the band 22*a*, so as to obtain a second bond 24, or linking, shown in FIG. 11.

A very firm and strong connection between the chain 2 and the fixed support 20 is thus obtained, but at the same time easily removable, in order to easily pass from one exercise to another.

Figure 13:
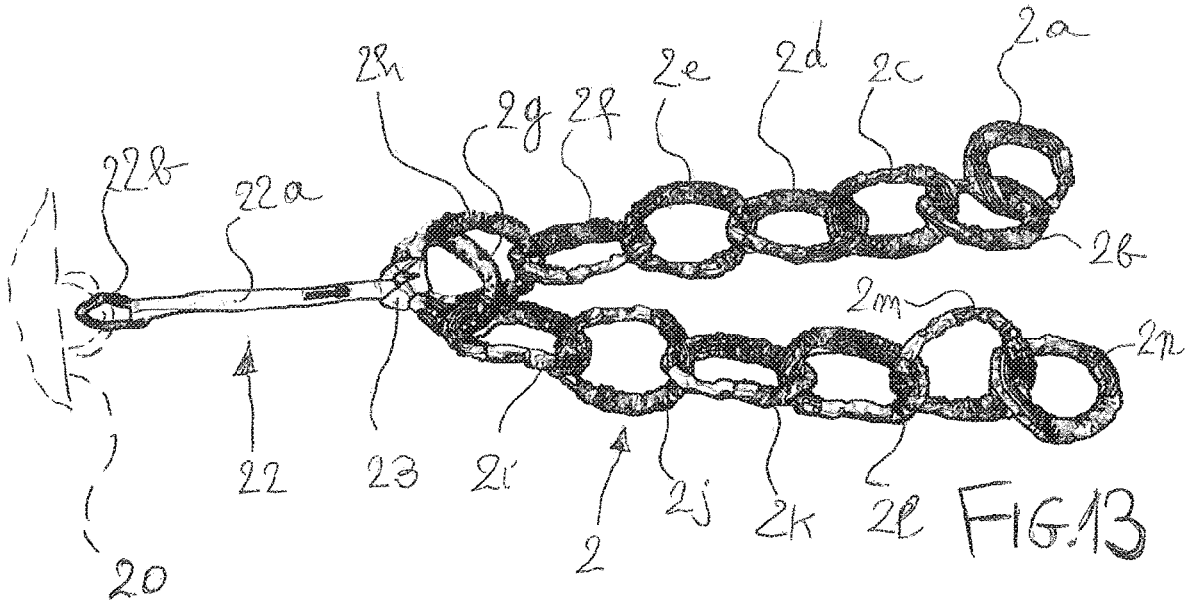
FIG. 13 is a perspective view of the tool, in another embodiment thereof, connected to a fixed support.
Figure 14:
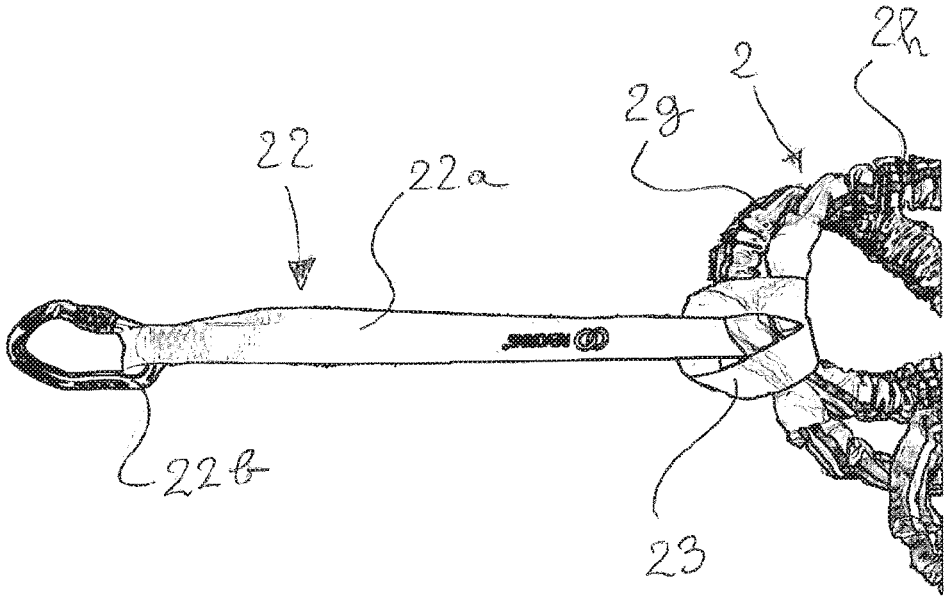
FIG. 14 is a detail of FIG. 13.

In another embodiment of the invention, shown in FIGS. 13,14, the fixing element 22 of chain 2 to the fixed support 20 includes a band 22*a* and a snap hook 22*b*.

In particular, the snap hook 22*b* comprises a substantially ring-shaped body, inside which the band 22*a* is inserted.

Band 22*a*, in turn, is connected to the connecting member 6 of one of the elastic rings 2*a*-2*n*, at a first bond 23.

The first bond 23 is achieved by wrapping band 22*a*, in closed loop, around the connecting member 6, and then passing one end of band 22*a* through the other end of band 22*a* itself.

More preferably, the aforementioned first bond 23, as disclosed above, as achieved between the band 22*a* and the contact area between the connecting members 6 of two adjacent elastic rings 2*a*-2*n* (preferably, but not exclusively, the two central elastic rings 2*g*,2*h*).

The ring-shaped body of snap hook 22*b*, in turn, can be connected to any fixed support 20.

This embodiment of tool 1 is more comfortable and easier to use, since the snap hook 22*b* can be easily and quickly connected to fixed supports 20 of different shapes and conformations.

The way of using the tool 1 according to the present invention is, in light of that described above, completely intuitive.

Figure 9:
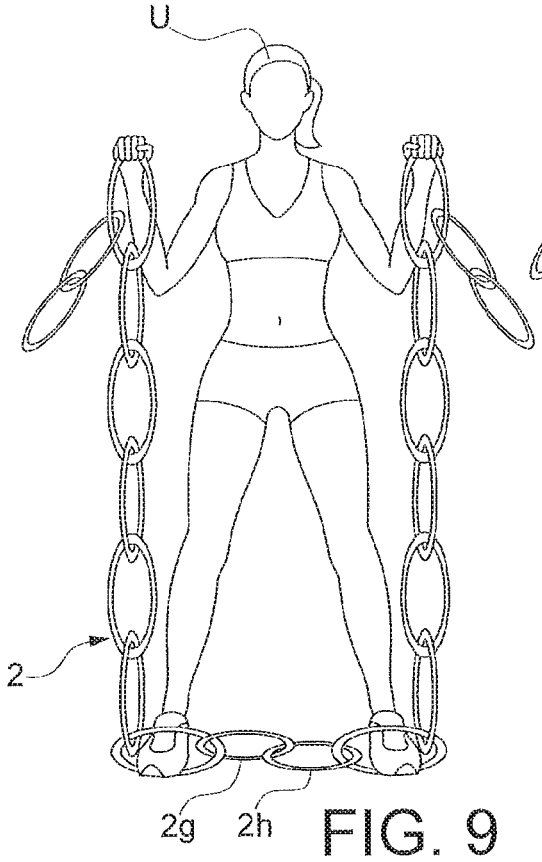
FIGS. 9,10 are schematic views of a user who carries out exercises that can be executed with the tool according to the present invention.
Figure 10:
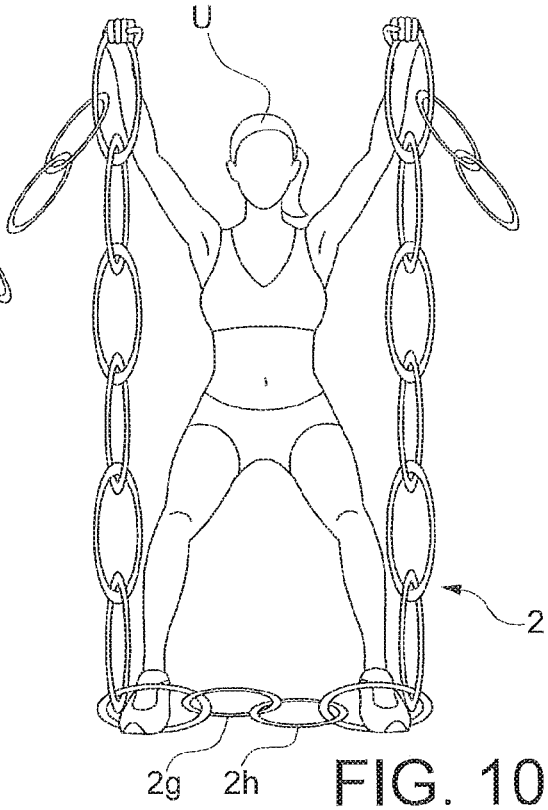

The tool 1 can be used to perform free body exercises, as shown in the embodiment of FIGS. 9,10, in which the user U selectively grips two elastic rings 2*a*-2*n* (possibly maintaining a portion of the chain 2 locked, e.g. at the central elastic rings 2*g*,2*h*), then carrying out simultaneous or alternated traction exercises with two limbs.

It is entirely evident that FIGS. 9,10 illustrate only one of the possible free body exercises that can be carried out with the tool 1 according to the invention, in a non-limiting manner.

Or, the tool 1 can be employed with the aid of a fixed support 20, as schematically illustrated in FIG. 11.

One of the most important technical features of the tool 1 according to the invention is the possibility to select the desired resistance to traction, by selectively gripping (or engaging) specific elastic rings 2*a*-2*n* and thus defining the length of the chain 2 of elastic rings 2*a*-2*n* actually placed under traction, in relation to the type of exercise to be carried out or in relation to the abilities of each user U.

Figure 18:
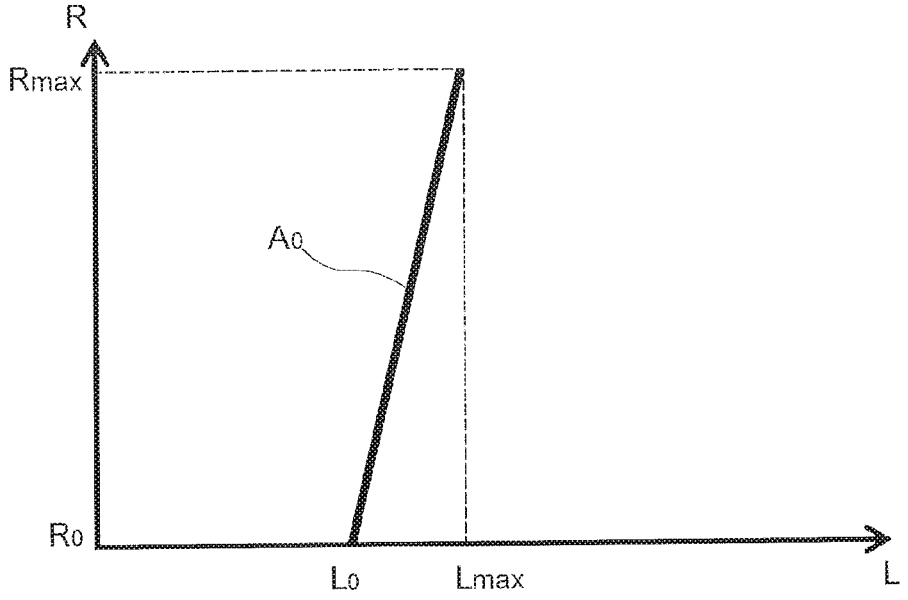
FIG. 18 (PRIOR ART)
FIG. 18 is a tension-elongation diagram of a conventional elastic band and (according to the prior art)
Figure 19:
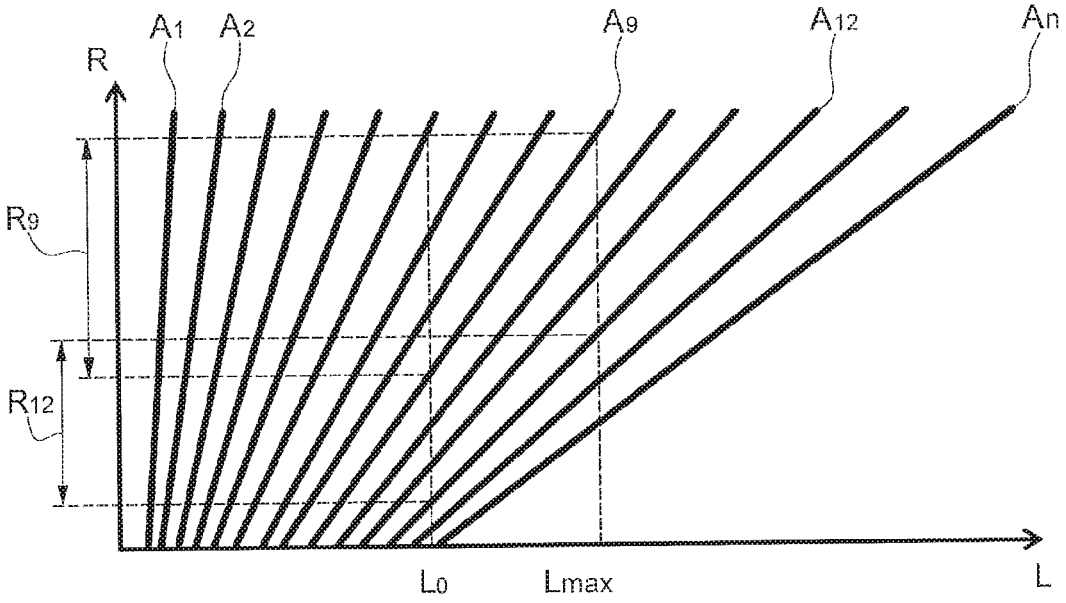
FIG. 19 is a tension-elongation diagram of the tool according to the present invention.

For a better comprehension, reference is made to FIGS. 18 and 19, in which the tension (y-axis)—elongation (x-axis) diagrams, respectively, of a conventional elastic band (according to the prior art), and of a tool according to the present invention, are represented.

As shown in FIG. 18, when using a conventional elastic band, the user has available only one range $A_0$ of elongation and resistance (i.e. the tension of the elastic band).

In particular, range $A_0$ is represented by the only straight line present in the diagram, while $L_0$ represents the rest length of the elastic band.

On the contrary, by using the tool according to the present invention (FIG. 19), the user can select the tension (i.e. the resistance to extension), the elongation, and also the increasing rate of the tension for each elongation value.

In detail, the user has a series $A_1, A_2 \ldots A_n$ of different ranges of elongation and tension, relating to which elastic ring 2*a*-2*n* he/she grasps in order to carry out the exercise.

For example, given the same elongation interval $L_0$-$L_{max}$ during the execution of the exercise, the user can select a range (e.g. $A_9$) characterized by a high resistance and a quick increase of the tension during traction; or, he/she can select a different range (e.g. $A_{12}$) characterized by a lower resistance and by a more gradual increase of the tension during traction; or again he/she can select any one intermediate situation.

Alternatively, the user can select a certain resistance value (assuming to draw a horizontal line in the diagram of FIG. 19) and, by identifying the desired range between those available, he can work with a specific elongation and with a specific tension increasing rate.

The diagram of FIG. 19 can also be supplied with the tool 1, so as to form a training kit that allows the user to best exploit the potentialities of the object.

This possibility can be exploited both in the execution of free body exercises and in those which provide for the aid of a fixed support 20, with great versatility and rapidity of passage from one kind of exercise to another.

In this sense, the version with fixed support 20 and relative fixing element 22 is particularly innovative; these make exercises—that cannot be carried out with known gym tools that are currently available on the market—easily executable.

The tool 1 can also be effectively combined/associated with other tools for physical exercise, such as for example those normally provided with gym machines with weight stack, or the like: for example, dumbbells or barbells for the exercise of specific muscular groups, which are normally connected (by means of a snap-hook) to a cable or to a chain, in turn associated with the weight stack.

The aforesaid tools (or other tools similar thereto, even suitably designed for this purpose) can therefore be connected, always by means of a simple snap-hook, or the like, to one (or more) of the elastic rings 2*a*-2*n* of the chain 2, so as to obtain a resisting force of desired amount.

Figure 15:
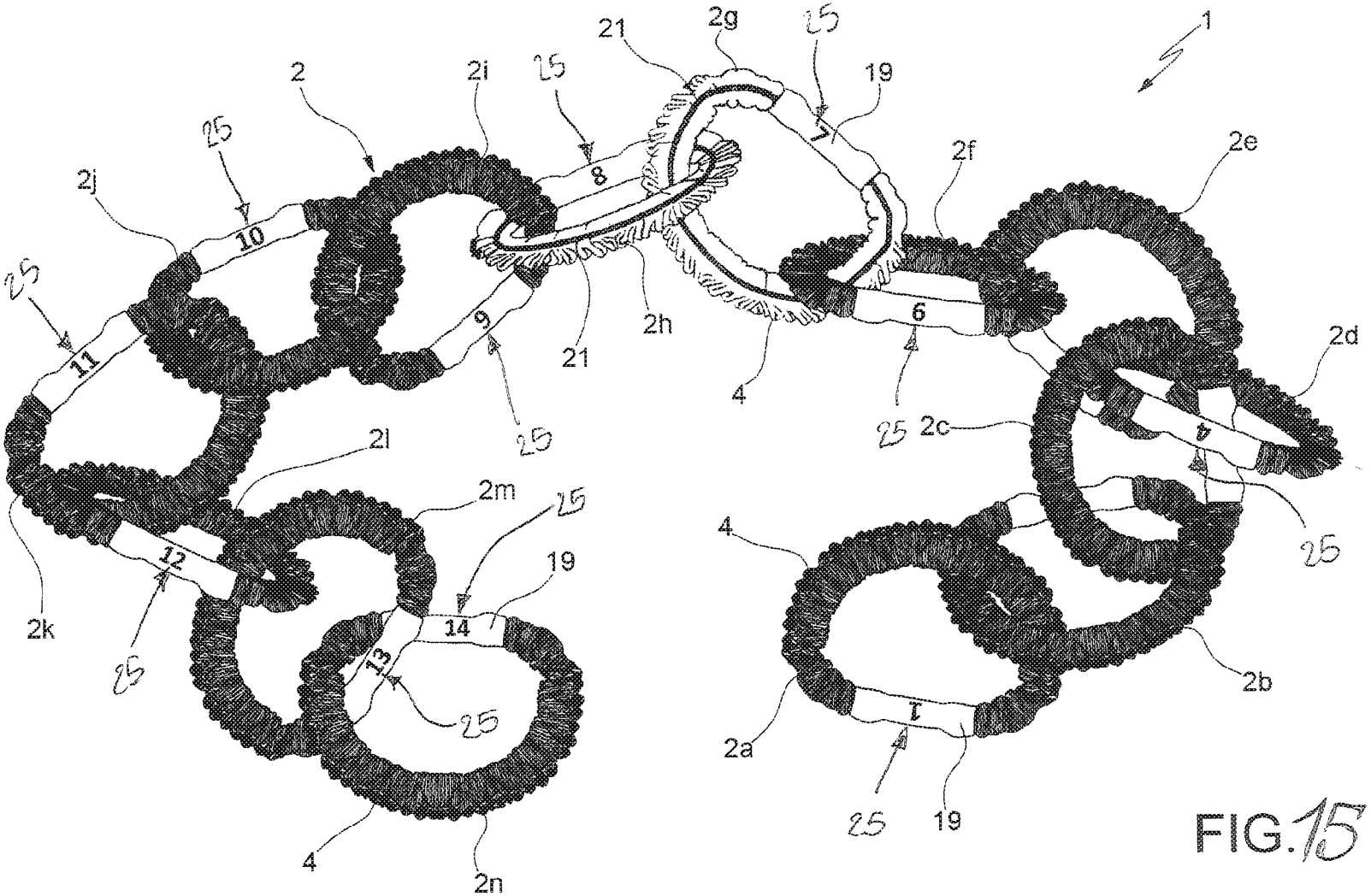
FIG. 15 is a perspective view of the tool, according to another embodiment of the invention.

Another embodiment of the tool according to the invention is shown in FIG. 15.

This embodiment differs from that of FIGS. 1-14 due to the fact that at least some of the elastic rings 2*a*-2*n* comprise respective identification elements 25.

By identification elements 25, it is intended elements which allow visually and unambiguously identifying each ring 2*a*-2*n* that composes the chain 2.

More preferably, in this embodiment, all the elastic rings 2*a*-2*n* of the chain 2 comprise respective identification elements 25.

In this embodiment, each of the identification elements 25 is unique for each of the rings 2*a*-2*n* of the chain 2.

The identification elements 25 are made on the surface of the covering 4 of each of the elastic rings 2*a*-2*n*, or even on the surface of the protective sheath 19: in FIG. 15, only for sake of simplicity, the identification elements 25 are made right on the surface of the protective sheath 19.

The identification elements 25 can for example be constituted by progressively increasing numbers, as schematically shown in FIG. 15.

In other embodiments of the invention, the identification elements 25 could be constituted by strips, or points, or still other signs that indicate, or refer to, a progressively increasing numbering in each of the elastic rings 2*a*-2*n*.

The identification elements 25 (whether these are numbers, signs or other) indicate a progressively increasing numbering starting from one terminal elastic ring 2*a* until the opposite terminal elastic ring 2*n* is reached.

The identification elements 25 can be made of different color with respect to that of the covering 4 or of the protective sheath 19, in such a way to make a chromatic contrast that makes them immediately visible and recognizable for the user.

The presence of the identification elements 25 allows the user U to immediately identify the elastic rings 2*a*-2*n* to be grasped (or engaged) in order to carry out a specific exercise with the desired elastic resistance, in a very intuitive manner.

The tool 1 can also be provided with support documentation for the user U (for example in the form of simple tables, or the like) suitable to show the different resistances obtainable by grasping the elastic rings 2*a*-2*n* marked by specific identification elements 25.

Such support documentation could also be incorporated in the chain 2 itself, e.g. in a label—or the like—connected to one of the elastic rings 2*a*-2*n* (in any case in a manner so as to not constitute an obstruction during the execution of the exercises), or fixed on the surface of the covering 4 of one of the aforesaid elastic rings 2*a*-2*n*.

Figure 16:
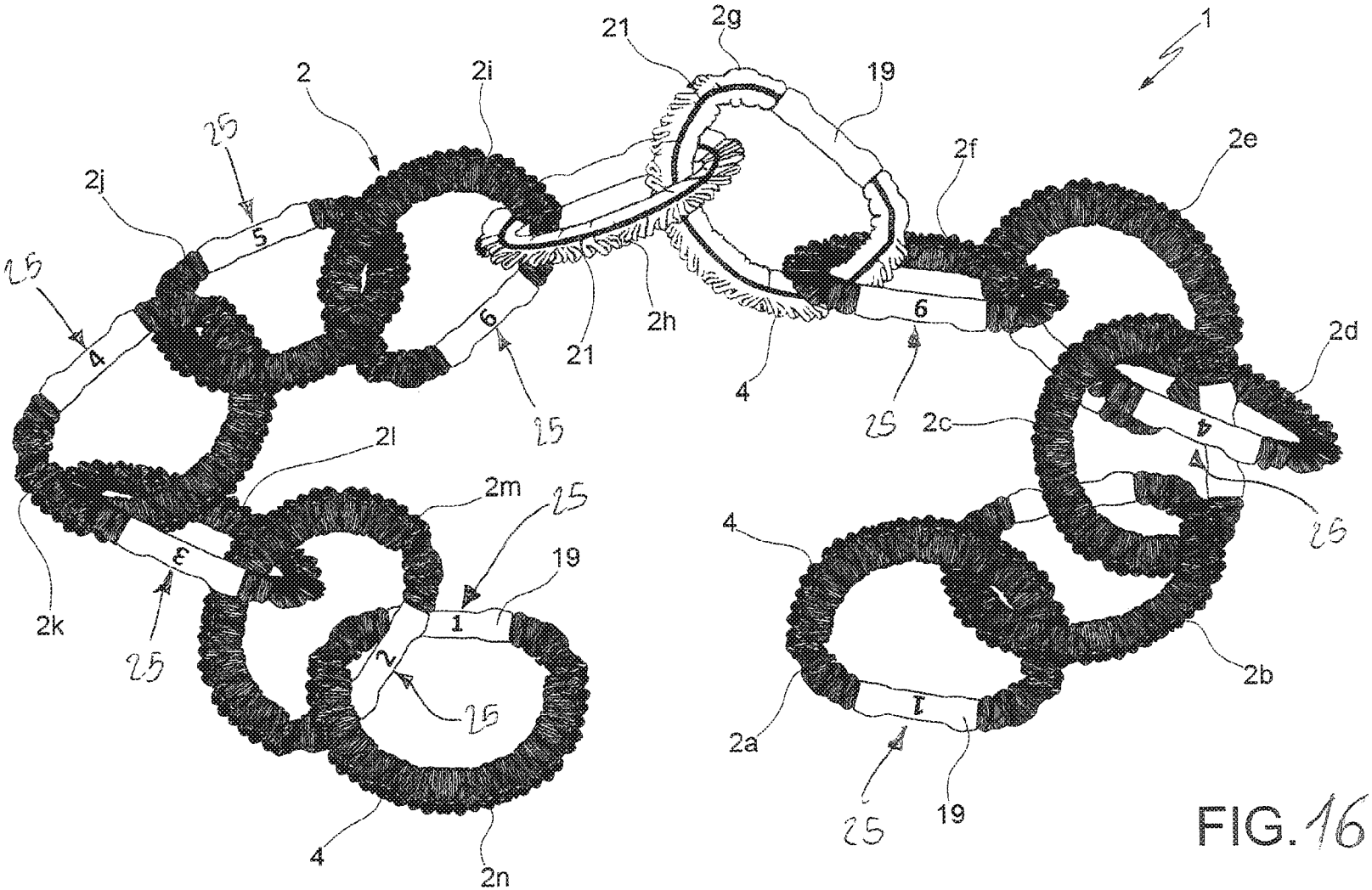
FIG. 16 is a perspective view of the tool, according to still another embodiment of the invention.

Another embodiment of the tool 1 according to the invention is shown in FIG. 16.

This embodiment differs from that of FIG. 15 in that the identification elements 25 are arranged symmetrical with respect to the central elastic rings 2*g*,2*h*.

In other words, the identification elements 25 are arranged in such a way that any two elastic rings 2*a*-2*n*, provided on opposite sides with respect to the central elastic rings 2*g*,2*h* and situated at the same distance from the latter, are marked by the same identification element 25: for example, the two terminal elastic rings 2*a*,2*n* are marked by the same identification element 25 (e.g. the number 1, or a single sign).

In the same manner, the two inner elastic rings 2*b*,2*m*, immediately contiguous with the terminal elastic rings 2*a*,2*n*, will be marked by the immediately following identification element 25 (the number 2, or two signs), and so on until the central elastic rings 2*g*,2*h* are reached (or the central ring 2*g*,2*h*, if there is only one).

As can be understood, this expedient can be particularly advantageous if the user U must execute exercises that simultaneously involve two symmetrical limbs or two extremities (e.g. the two arms, or the two legs), just as shown in FIGS. 9,10.

Indeed, typically in this case, the tool 1 is constrained in any manner (for example with fixing elements 22 of the described type, or with specific parts of the body of the user U, as in the case of the feet of FIGS. 9,10) at the central elastic rings 2*g*,2*h*, such that the two identical branches of the tool 1 are isolated.

Hence, if the user U wishes to obtain the same resistance to traction in the two branches of the tool 1, he/she grasps—or engages—two elastic rings 2*a*,2*n* marked by the same identification element 25, with two symmetrical limbs or extremities.

This ensures that the elastic resistance that the user U feels is the same in the two branches of the tool 1; as an alternative, the user U can also chose to grasp (or engage) two elastic rings 2*a*,2*n* marked by different identification elements 25, so as to obtain different elastic resistances in the two branches (for example in order to train, in a different manner, the two limbs or the two involved parts of the body).

Also in this case, the tool 1 can be equipped with support documentation for the user U (e.g. in the form of simple tables, or the like) adapted to illustrate, in a very immediate and intuitive manner, the different resistances obtainable by grasping the elastic rings 2*a*,2*n* marked by specific identification elements 25.

In another embodiment of the invention, the elastic rings 2*a*-2*n* could comprise two separate series of identification elements 25, and in particular a first series of identification elements 25 which indicate a numbering progressively increasing from one terminal elastic ring 2*a* to the opposite terminal elastic ring 2*n*, and a second series of identification elements 25 symmetrically arranged with respect to the central elastic rings 2*g*,2*h*, as described above.

In this manner, the user U can use the two series of identification elements 25 for executing different types of exercises.

Figure 17:
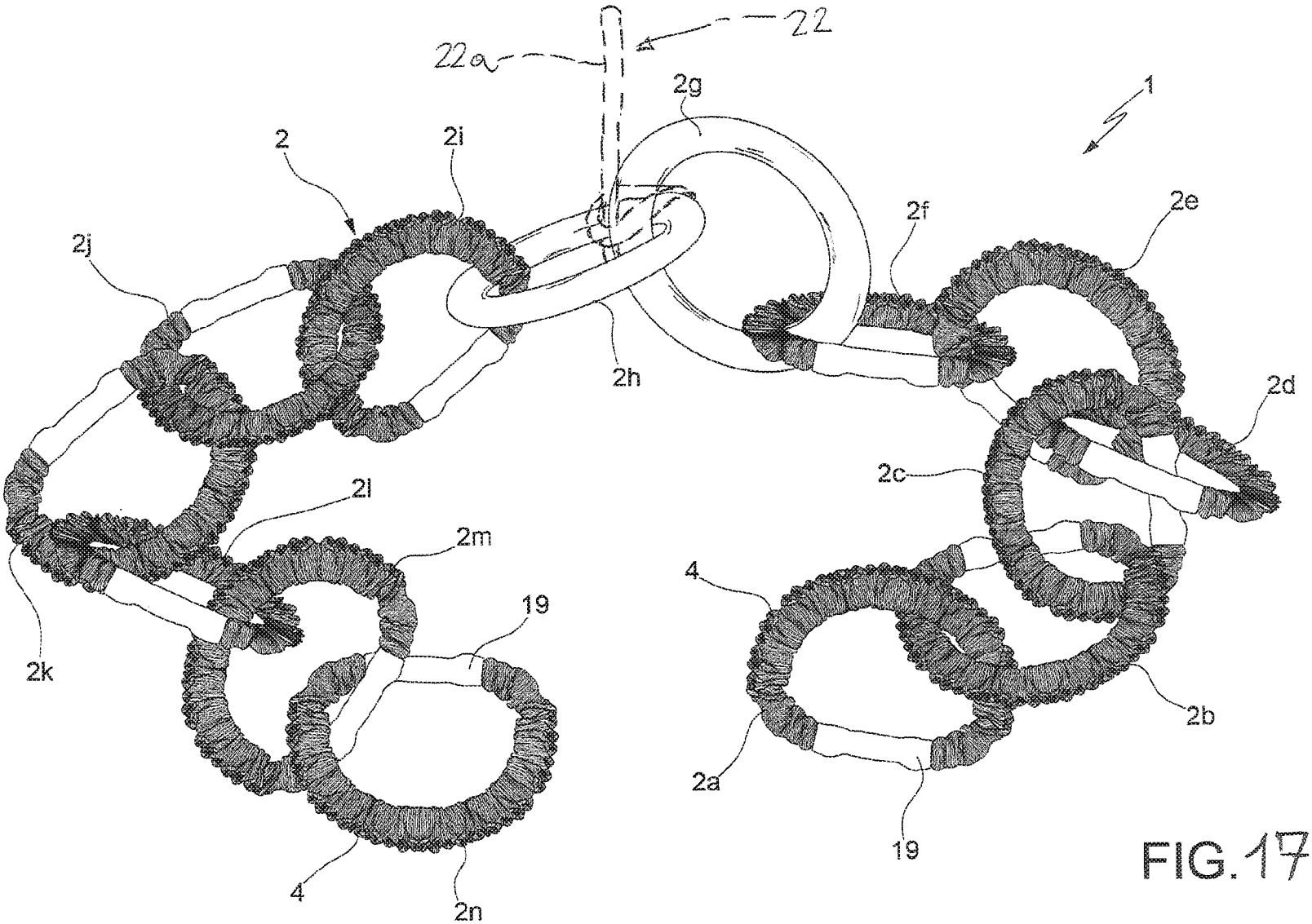
FIG. 17 is a perspective view of the tool, according to a further embodiment of the invention.

A further embodiment of the invention is shown in FIG. 17.

This embodiment differs from the one shown in FIGS. 1-14 in that the two central rings 2*g*,2*h* of the chain 2 are not elastic; on the contrary, they are made of rigid material.

The remaining rings 2*a*-2*f* and 2*i*-2*n* are instead elastic, and they have the same features disclosed with reference to the previous embodiments.

For example, such rigid material could include plastic, wood, metal, or other material having suitable features, or a combination of such materials.

The shape of the central rings 2*g*,2*h* could be any, without limitations.

For example, the central rings 2*g*,2*h* could be circular, oval, or other shapes yet.

In this embodiment, the tool 1 also includes a fixed support 20 and a related fixing element 22 (the fixed support 20 and the fixing element 22 have the same features disclosed with reference to the previous embodiments).

The main purpose of the interposition of two rigid central rings 2*g*,2*h* between the elastic rings 2*a*-2*f* and 2*i*-2*n*, is to modify the conditions for connecting the chain 2 to the fixing element 22 and, consequently, to the fixed support 20.

In fact, in the event that the fixing element 22 includes a band 22*a* having the features previously disclosed, the band 22*a* is connected to the two rigid central rings 2*g*,2*h* in the manner already disclosed, that is, by realizing a first bond 23 which surrounds, in this case, two rigid bodies.

When the user U performs the exercises, the two rigid central rings 2*g*, 2*h*, not participating in the lengthening of the chain 2, make the connection to the fixed support 20 much more stable: for example, in the case in which the user U performs, during the traction, wide movements with the limbs (for example circular movements, or the like) the presence of the two rigid central rings 2*g*, 2*h* keeps the connection of the band 22*a* substantially stable to the fixed support 20, even if the two branches 2*a*-2*f* and 2*i*-2*n* of the chain 2 move widely, even not in synchronism.

In the absence of the two rigid central rings 2*g*, 2*h*, the movements of the two branches 2*a*-2*f* and 2*i*-2*n* of the chain 2 could cause undesirable movements or deformations of the band 22*a* (which, for example, could twist).

This embodiment of the tool 1 has advantages also in use without the fixing element 22 to the fixed support 20.

In fact, in the execution—for example—of exercises of the type shown in FIGS. 9,10, the presence of rigid central rings 2*g*, 2*h* allows a more secure and stable locking of the chain 2, under the feet.

In all the above-described embodiments, the number of elastic rings 2*a*-2*n* which compose the chain 2 is comprised between three and one hundred; preferably, it is comprised between five and twenty.

In particular, the number of the elastic rings 2*a*-2*n* which compose the chain 2 is at least five, since this allows obtaining a minimum configuration comprising an central elastic ring and four further lateral elastic rings: in this manner, by executing, for example, an exercise in which the central elastic ring is constrained to a fixed support 20, two consecutive elastic rings are available, for each of the two sides that are thus defined, such that the user U can select one or the other in order to vary the resistance to traction.

In an embodiment of the invention, the number of elastic rings 2*a*-2*n* which make up the chain 2 is twelve.

In another embodiment of the invention, of particular practical interest, the number of elastic rings 2*a*-2*n* which make up the chain 2 is fourteen.

More generally, in preferred embodiments of the invention, the number of elastic rings 2*a*-2*n* which make up the chain 2 is even.

This allows the two central elastic rings 2*g*, 2*h* to be used for connection to the fixing element 22, in particular by coupling the latter to the contact area between the connection members 6 of the two central elastic rings 2*g*, 2*h*.

Each of the elastic rings 2*a*-2*n* of the chain 2 can have a rest diameter comprised between about 10 cm and about 60 cm.

As stated, within a same chain 2, elastic rings 2*a*-2*n* of different size can be provided.

Many different combinations can be clearly obtained by varying parameters such as the number of the elastic rings 2*a*-2*n*, their size, the size of the cross-section of each elongated elastic element 5, the type of material used for making each elongated elastic element 5, and still others.

It was thus seen that the invention achieves the proposed purposes.

The present invention was described according to preferred embodiments, but equivalent variants can be conceived without departing from the protective scope offered by the following claims.

The invention claimed is:

1. A tool for physical training and rehabilitation, comprising a plurality of rings linked in succession to make an open chain, wherein each of said rings is grippable with hands to perform specific exercises, or wherein each of said rings is engageable by other parts of the body of the user for performing other kind of exercises, wherein at least some of said rings are elastic, and the elastic rings comprise at least one core made of an elastic material and at least one covering of said core made of a material that is non-elastic with respect to said core, wherein said covering is configured as an accordion such that when said core is not stressed under traction the covering has a large fitting on the core itself, and when said core is stressed under traction/extension said covering is extended in order to conform to the extension of said core, wherein said core comprises at least an elongated elastic element, having two opposite ends, and at least a connection member linked, or knotted, to said ends, and wherein said connection member of said ends is made of yielding and non-elastic material, and the connection member is extended for a pre-established portion of a length of the respective elastic ring, wherein said connection member constitutes a grip zone during the execution of exercises, and wherein each of said elastic rings comprises a respective external elastic protective sheath, which covers said covering at said connection member, further comprising at least a fixed support and a fixing element for fixing at least one of said elastic rings to said fixed support, wherein said connection member comprises at least one strip provided with two opposite terminal eyelets, with which said ends of said elongated elastic element are respectively linked, or knotted.

2. The tool according to claim 1, wherein all the rings of said chain are elastic.

3. The tool according to claim 2, wherein said elastic rings include two central rings having the respective coverings of a different color than the coverings of the remaining elastic rings.

4. The tool according to claim 1, wherein said covering comprises at least a tube made of yielding and non-elastic material, having two terminal ends with one end superimposed on the other at said connection member, and fixed to each other by means of constraining means selected from among stitching, gluing or stapling.

5. The tool according to claim 1, wherein at least some of said elastic rings comprise respective and distinct identification elements.

6. The tool according to claim 5, wherein said identification elements are selected from among progressively increasing numbers, strips, dots, or other signs that indicate a progressively increasing numbering.

7. The tool according to claim 6, wherein said identification elements are selected from among progressively increasing numbers, strips, dots, or other signs that indicate a progressively increasing numbering, and are arranged symmetrical with respect to said central elastic rings.

8. The tool according to claim 1, comprising two central rings made of a rigid material, while the remaining rings of said chain are elastic.

9. The tool according to claim 8, comprising at least a fixed support and at least a fixing element for fixing said rigid central rings to said fixed support.

10. The tool according to claim 1, wherein each of said ends of said elongated elastic element is inserted in a respective terminal eyelet of said strip, each of said ends being folded upon itself and constrained to the same elongated elastic element, so as to make a respective counter-eyelet.

11. The tool according to claim 10, wherein each of said terminal eyelets of said strip has a terminal portion, wherein said terminal portion is twisted towards the interior of the cavity of the terminal eyelet itself, so as to define two contiguous passages for the insertion of said respective end of said elongated elastic element first in one direction and then in the opposite direction, thus obtaining a compact linking zone between said strip and said elongated elastic element, in which said strip encloses and wraps the respective counter-eyelet of said elongated elastic element.

12. The tool according to claim 11, wherein said elongated elastic element is selected from among an elastic tube, an elastic rope, an elastic band, or a combination thereof.

13. The tool according to claim 12, wherein said elongated elastic element is constituted by an elastic tube, each of said ends being affected by a respective longitudinal cut, which is extended for a certain length and which allows opening the wall of said elastic tube, such that said wall can enclose the external surface of said elastic tube itself after the bending necessary for making said counter-eyelet.

14. A tool for physical training and rehabilitation, comprising a plurality of rings linked in succession to make an open chain, wherein each of said rings is grippable with hands to perform specific exercises, or wherein each of said rings is engageable by other parts of the body of the user for performing other kind of exercises, wherein at least some of said rings are elastic, and the elastic rings comprise at least one core made of an elastic material and at least one covering of said core made of material that is non-elastic with respect to said core, wherein said covering is configured as an accordion such that when said core is not stressed under traction the covering has a large fitting on the core itself, and when said core is stressed under traction/extension said covering is extended in order to conform to the extension of said core, wherein said core comprises at least an elongated elastic element, having two opposite ends, and at least a connection member linked, or knotted, to said ends, and wherein said connection member of said ends is made of yielding and non-elastic material, and the connection member is extended for a pre-established portion of a length of the respective elastic ring, wherein said connection member constitutes a grip zone during the execution of exercises, and wherein each of said elastic rings comprises a respective external elastic protective sheath, which covers said covering at said connection member, and wherein said tool comprises at least a fixed support and at least a fixing element for fixing at least one of said elastic rings to said fixed support, wherein said connection member comprises at least one strip provided with two opposite terminal eyelets, with which said ends of said elongated elastic element are respectively linked.

15. The tool according to claim 14, wherein said fixing element comprises at least one band, closed on itself as a loop, made of yielding and non-elastic material, said band being connected to said chain at a first bond made at the connection member of one of said elastic rings of said chain, said first bond being achieved by wrapping said band, around said connection member, and then passing and end of said band through the other end of said band.

16. The tool according to claim 15, wherein said first bond of said band is made at the contact area between the connection members of two adjacent elastic rings.

17. The tool according to claim 16, wherein said fixing element further includes a snap hook, comprising a substantially ring-shaped body inside which said band is inserted, said ring-shaped body being directly mated to said band and to said fixed support.

* * * * *